US008358251B2

(12) United States Patent
Fischer

(10) Patent No.: US 8,358,251 B2
(45) Date of Patent: Jan. 22, 2013

(54) ANTENNA FOR A BACKSCATTER-BASED RFID TRANSPONDER

(75) Inventor: Martin Fischer, Pfedelbach (DE)

(73) Assignee: Atmel Corporation, San Jose, CA (US)

( * ) Notice: Subject to any disclaimer, the term of this patent is extended or adjusted under 35 U.S.C. 154(b) by 622 days.

(21) Appl. No.: 11/945,257

(22) Filed: Nov. 26, 2007

(65) Prior Publication Data

US 2008/0143535 A1 Jun. 19, 2008

Related U.S. Application Data

(60) Provisional application No. 60/860,792, filed on Nov. 24, 2006.

(30) Foreign Application Priority Data

Nov. 25, 2006 (DE) ..... 10 2006 055 744

(51) Int. Cl.
*H01Q 9/26* (2006.01)

(52) U.S. Cl. ..... 343/804; 343/803; 343/700 MS

(58) Field of Classification Search ..... 343/907, 343/803, 804, 806, 700 MS, 795, 895
See application file for complete search history.

(56) References Cited

U.S. PATENT DOCUMENTS

| | | | |
|---|---|---|---|
| 6,963,317 | B2 | 11/2005 | Zuk et al. |
| 6,999,028 | B2 * | 2/2006 | Egbert ..... 343/700 MS |
| 7,262,740 | B2 * | 8/2007 | Tikhov et al. ..... 343/770 |
| 2005/0024287 | A1 | 2/2005 | Jo et al. |
| 2006/0158380 | A1 | 7/2006 | Son et al. |
| 2006/0208900 | A1 | 9/2006 | Tavassoli Hozouri |

FOREIGN PATENT DOCUMENTS

| | | | |
|---|---|---|---|
| DE | 29823087 | U1 | 6/2000 |
| DE | 10393263 | T5 | 9/2005 |
| EP | 1703589 | A1 | 9/2006 |
| EP | 1 826 866 | A1 | 8/2007 |
| EP | 1826866 | A1 * | 8/2007 |
| WO | WO 2004/027681 | A2 | 4/2004 |
| WO | WO 2006/064540 | A1 | 6/2006 |

OTHER PUBLICATIONS

C. Cho. H. Choo et al., "Broadband RFID tag antenna with quasi-isotropic radiation pattern", Electronics Letters, vol. 41, No. 20, Sep. 29, 2005, pp. 1091-1092.

* cited by examiner

*Primary Examiner* — Jacob Y Choi
*Assistant Examiner* — Kyana R McCain
(74) *Attorney, Agent, or Firm* — Baker Botts L.L.P.

(57) ABSTRACT

An antenna for a backscatter-based RFID transponder is provided that has an integrated receive circuit having a capacitive input impedance for receiving a radio signal spectrally located in an operating frequency range. The antenna includes two antenna branches that extend outward from a connecting region in which the antenna branches can be connected to the integrated receive circuit, and a yoke-shaped first trace segment that is designed to connect the two antenna branches together. Each antenna branch can have a U-shaped second trace segment connected to the connecting region, and a U-shaped third trace segment connected to the second trace segment and extending parallel to the second trace segment. The invention further relates to a backscatter-based RFID transponder with such an antenna.

25 Claims, 3 Drawing Sheets

ANTENNA FOR A BACKSCATTER-BASED RFID TRANSPONDER

This nonprovisional application claims priority to German Patent Application No. DE 102006055744, which was filed in Germany on Nov. 25, 2006, and to U.S. Provisional Application No. 60/860,792, which was filed on Nov. 24, 2006, and which are both herein incorporated by reference.

BACKGROUND OF THE INVENTION

1. Field of the Invention

The present invention relates to an antenna for a backscatter-based RFID (radio frequency identification) transponder, and a backscatter-based RFID transponder having such an antenna.

2. Description of the Background Art

The invention resides in the field of wireless and contactless communication. It resides particularly in the field of radio-based communication for the purpose of identifying objects, animals, persons, etc., as well as the transponders and remote sensors used for this purpose.

While applicable in principle to any desired contactless communication system, the present invention and the problem on which it is based are described below with reference to RFID communications systems and their applications. In this connection, RFID stands for "Radio Frequency Identification."

In RFID systems, data is transmitted bidirectionally with the aid of high-frequency radio signals between a stationary or mobile base station, which is often also referred to as a reader or read/write device, and one or more transponders that are attached to the objects, animals or persons to be identified.

The transponder, which is also referred to as a tag or label, typically has an antenna for receiving the radio signal emitted by the base station, as well as an integrated circuit (IC) connected to the antenna. In this context, the integrated circuit includes a receive circuit for receiving and demodulating the radio signal and for detecting and processing the transmitted data. In addition, the integrated circuit has a memory for storing the data needed for identification of the corresponding object. Furthermore, the transponder can include a sensor, for example for temperature measurement, which is likewise part of the integrated circuit, for instance. Such transponders are also known as remote sensors.

RFID transponders can be used to advantage anywhere that automatic identification, detection, interrogation, or monitoring is to take place. The use of such transponders makes it possible for objects such as, for example, containers, pallets, vehicles, machines, or pieces of luggage, but also animals or people, to be individually marked and identified in a contactless way without a line-of-sight connection. In the case of remote sensors, it is additionally possible for physical qualities or parameters to be measured and interrogated.

In the area of logistics, containers, pallets and the like can be identified, for example in order to determine their current whereabouts during the course of shipping. In the case of remote sensors, the temperature of the transported goods or products can be regularly measured and stored, for example, and read out at a later point in time. In the area of cloning protection, items such as integrated circuits can be provided with a transponder in order to prevent unauthorized reproduction. In commercial applications, RFID transponders can replace the barcodes often placed on products. Additional applications include, for example, driveaway protection in the automotive field, or systems for monitoring the air pressure in tires, as well as in systems for personal access control.

Passive transponders have no independent energy supply, and extract the energy required for their operation from the electromagnetic field emitted by the base station. Semi-passive transponders, while they do indeed have their own energy supply, do not use the energy provided by it to transmit/receive data, but instead use it to operate a sensor, for example.

RFID systems with passive and/or semi-passive transponders whose maximum distance from the base station is significantly over one meter are operated in particular in frequency ranges in the UHF or microwave range.

In such passive/semi-passive RFID systems with a relatively long range, a backscattering-based method is generally used for data transmission from a transponder to the base station, in the course of which a portion of the energy from the base station arriving at the transponder is reflected (backscattered). In this process, the carrier signal is modulated in the integrated circuit according to the data to be transmitted to the base station and is reflected by means of the transponder antenna. Such transponders are referred to as backscatter-based transponders.

In order to achieve the greatest possible range with backscatter-based transponders, it is necessary to deliver the largest possible fraction of the energy arriving at the transponder from the base station to the integrated receive circuit of the transponder. Power losses of every type must be avoided in this process. On the one hand, this requires transponder antennas with a relatively broad receive frequency range. Such relatively wide-band antennas can have the additional advantage of meeting the requirements of multiple national or regional authorities with only one antenna type. On the other hand, the energy picked up by the transponder antenna must be delivered, with as little reduction as possible, to the integrated receive circuit, which typically has a capacitive input impedance, i.e. an impedance with a negative imaginary part.

Known from DE 103 93 263 T5, which corresponds to U.S. Pat. No. 6,963,317, is an antenna for an RFID system which has a planar helix structure with two branches. Starting from a central region, each of the two branches extends outward in a helix. The input impedance of this antenna is also capacitive.

A disadvantage here is that the impedance of this antenna differs sharply from the complex conjugate value of the impedance of the chip input circuit, and thus that an additional, separate matching circuit with a coil and a capacitor is required. Because of parasitic resistances of these components, power losses arise in the transponder, disadvantageously reducing the range. Moreover, the separate matching circuit restricts the freedom in placement of the chip and results in more complex and thus more expensive implementations of the transponder.

From the article, "Broadband RFID tag antenna with quasi-isotropic radiation pattern," by C. Cho, H. Choo and 1. Park, published in Electronics Letters, Vol. 41, No. 20, Sep. 29, 2005, pages 1091-1092, an antenna is known for a UHF RFID system that has two folded dipoles and a twin-T matching network. The area required by this antenna is 79 mm×53 mm. A region of 1.7 m to 2.4 m is given as the range of the RFID system.

However, for many applications only a relatively small area is available. In addition, elongated antennas having a relatively small width of approximately 35 mm and a length of up to 100 mm are advantageous for some applications, and for simple manufacture of the antenna on a strip. Moreover, many applications require greater range.

SUMMARY OF THE INVENTION

It is therefore an object of the present invention to provide an antenna for a backscatter-based RFID transponder with an integrated receive circuit (IC) for receiving a radio signal spectrally located in an operating frequency range, that permits simpler and more economical implementations while still permitting very wide-band reception of high-frequency radio signals as well as having directional characteristics that are as omnidirectional as possible. It is a further object of the invention to provide a backscatter-based RFID transponder that is simple and inexpensive to implement and that has a relatively long range with very wide-band, omnidirectional reception of high-frequency radio signals.

In an embodiment of the present invention, the antenna includes: a) two antenna branches that extend outward from a connecting region in which the antenna branches can be connected to the integrated receive circuit, b) a yoke-shaped first trace segment that is designed to connect the two antenna branches together, wherein c) each antenna branch has a U-shaped second trace segment connected to the connecting region, and d) each antenna branch has a U-shaped third trace segment connected to the second trace segment and extending parallel to the second trace segment.

The backscatter-based RFID transponder can have an integrated receive circuit with a capacitive input impedance and an antenna according to the invention connected with the integrated receive circuit.

In an embodiment, two U-shaped trace segments are placed parallel or substantially parallel to one another and are connected to one another (contacting) in each of the two antenna branches. This makes possible antennas and transponders that require only a very small, e.g. elongated, area and that can be implemented in a simpler and more economical manner. At the same time, such an antenna permits greater ranges while still allowing very wide-band and largely omnidirectional reception of high-frequency radio signals.

In an embodiment, the second and third trace segments are designed such that the antenna can have an input impedance in the operating frequency range with an inductive reactance whose frequency response has an inflection point and/or a local minimum value and/or a local maximum value in the operating frequency range. To this end, a trace length along the second and third trace segments is selected such that this requirement on the frequency response is met. This permits very long ranges and a particularly wide-band and largely omnidirectional reception of high-frequency radio signals.

In another embodiment, the second and third trace segments can each be piecewise linear in design. In this way, better area utilization by the antenna can be achieved for a given rectangular or square area.

In another embodiment, the first trace segment is designed so that the antenna can have an inductive impedance in the operating frequency range that approximates the complex conjugate values of the capacitive impedance in such a manner that no circuit arrangement is needed for impedance matching between the antenna and integrated receive circuit. The first trace segment 24 can be designed such that the antenna has an inductive impedance in the operating frequency range whose real component is below 35 ohms and whose imaginary component has a magnitude above 170 ohms. This results in particularly long ranges as well as transponders that are particularly simple to implement.

Each antenna branch can have a serpentine fourth trace segment that is designed to connect the connecting region to the second trace segment of the antenna branch. In this way, it is advantageously possible to reduce the overall length of the area occupied by the antenna. Preferably, the fourth trace segments in this context have a third trace width that is smaller than a first trace width of a second or third trace segment. By this means, small effective resistances of the antenna impedance can advantageously be achieved.

In an embodiment of the inventive RFID transponder, the integrated receive circuit is arranged in the connecting region of the antenna. This permits very simple implementations of the transponder.

In another embodiment, each antenna branch includes a thin conductive layer that is formed on a substrate, and the integrated receive circuit is formed on this substrate.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
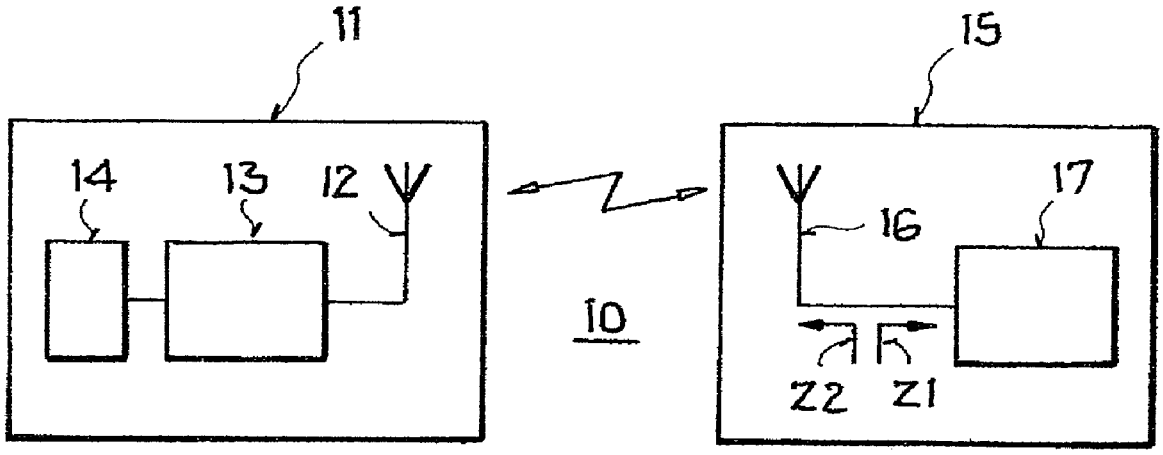
FIG. 1 illustrates an RFID system with an inventive transponder.

FIG. 1 schematically shows an example of an RFID system. The RFID system 10 has a base station 11 and at least one inventive transponder 15. By means of high-frequency radio signals, the base station 11 exchanges data with the transponder or transponders 15 in a contactless and bidirectional fashion.

The base station 11 has at least one antenna 12 for transmitting and receiving radio signals in an operating frequency range fB, a transmitting/receiving unit 13 connected to the antenna(s) for transmitting and receiving data, and a control unit 14 connected to the transmitting/receiving unit for controlling the transmitting/receiving unit 13.

The backscatter-based passive or semi-passive transponder 15 has an antenna 16 for receiving the radio signal spectrally located in the operating frequency range fB, and has, connected to the antenna, a receive circuit 17 for demodulating the received radio signal and for detecting the data contained therein. The receive circuit 17 here is part of an integrated circuit (IC) that is not shown in FIG. 1, for example an ASIC (application specific integrated circuit) or an ASSP (application specific standard product), which normally has in addition a memory for storing the data required for identification of the corresponding object. If applicable, the transponder 15 or the integrated circuit contains additional components that are not shown in FIG. 1, such as a sensor for temperature measurement, for example. Such transponders are also known as "remote sensors."

The explanation below assumes that the operating frequency range fB is in the UHF frequency band, specifically in a frequency range between approximately 840 MHz and approximately 960 MHz. Alternatively, the operating frequency range can also range in the ISM (industrial, scientific, medical) band, which is available almost everywhere in the world, between 2.4 and 2.5 GHz. Additional alternative operating frequency ranges are found at 315 MHz, 433 MHz and 5.8 GHz.

As a result of differences in existing requirements of regulatory authorities with respect to the maximum permissible transmit power in the frequency range between 840 MHz and 960 MHz, ranges of approximately 5 m for the European market (500 mW ERP) and of approximately 11 m for the USA (4 W EIRP) are desired in read operation.

The integrated receive circuit 17 or the input circuit of the IC has a complex-valued input impedance Z1 with a real component (effective resistance) R1 and an imaginary component (reactance) X1. In order to minimize power losses, the effective resistance R1 here is preferably relatively small. The reactance X1 is generally capacitive (X1<0) and in particular has a larger magnitude than the effective resistance, |X1|>R1, for small values of the effective resistance R1.

Integrated receive circuits 17 developed by the applicant have input impedances Z1 with effective resistances R1 in the range of approximately 4 to 35 ohms, and have capacitive reactances X1 whose absolute values are greater than approximately 170 ohms. The magnitude of the imaginary component (|X1|) thus significantly exceeds the real component (R1): |X1|>4*R1. With advances in integrated circuit production technology and the associated decreases in structure sizes, capacitive reactances X1 with further increases in magnitude are to be expected.

The antenna 16 of the transponder 15 has antenna branches that extend outward from a connecting region in which the antenna branches are connected (contacted) to the integrated receive circuit 17. The antenna branches and the integrated receive circuit 17 are preferably embodied on a common substrate. Example embodiments of the antenna 16 are described below.

Figure 2:
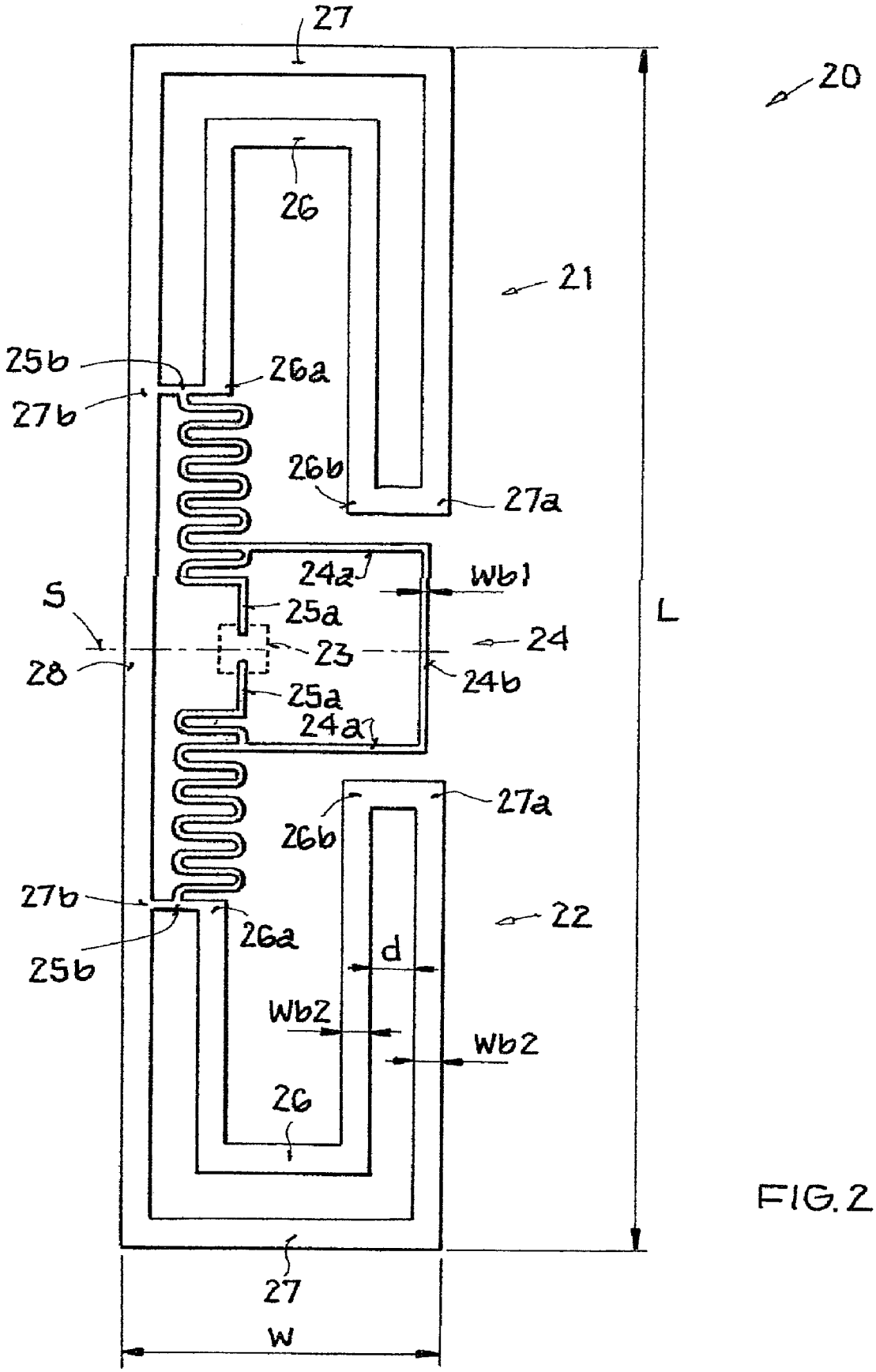
FIG. 2 illustrates an example embodiment of an inventive antenna.

FIG. 2 shows a top view of a first example embodiment of an inventive antenna for a backscatter-based RFID transponder 15 in accordance with the description above.

The antenna has exactly two antenna branches 21 and 22 which extend outward from a connecting region 23 in which the antenna branches are connected to the integrated receive circuit 17 (FIG. 1). The branches 21, 22 here are connected together by means of a yoke-shaped trace segment 24. Each antenna branch 21, 22 has a serpentine trace segment 25 that is connected to the connecting region 23, a U-shaped trace segment 26 connected to and adjoining the segment 25, and another U-shaped trace segment 27 connected to and adjoining the segment 26 that extends parallel to the segment 26.

Each leg of the U-shaped segment 26 here is located parallel to a respective adjacent leg of the U-shaped segment 27 of the same antenna branch, so that the three legs of the segment 26 extend parallel to and at a uniform (constant) spacing d from the three legs of the segment 27 of the same antenna branch. Moreover, in each branch, the segment 26 is located in an inner area surrounded by the segment 27, wherein the openings of the two U-shaped segments face in the same direction.

If the two ends of the U-shaped trace segment 26 are labeled 26*a* and 26*b*, and those of the U-shaped segment 27 are labeled 27*a*, 27*b*, then in each antenna branch 21, 22 an outer end 26*b* of the segment 26 is connected to an outer end 27*a* of the segment 27, so that the U-shaped segments 26, 27 of the same antenna branch are each connected together at a respective outer ("first") end 26*b*, 27*a* in an electrically conductive manner. Here, an "outer" end is understood to mean the ("first") end of the relevant segment that is further separated (in terms of path length) along the trace segment from the connecting region 23 than the other, inner ("second") end of the same segment. The "outer" end thus corresponds to the end facing away (along the segment) from the connecting section 23.

Furthermore, in each antenna branch 21, 22 an inner end 26*a* of the segment 26 is connected to an inner end 27*b* of the segment 27, so that the U-shaped segments 26, 27 of the same antenna branch are also connected to one another in an electrically conductive manner at the other inner ("second") end 26*a*, 27*b*.

Moreover, in each antenna branch 21, 22, the inner end 26*a* and the inner end 27*b* are connected to the connecting region 23, specifically through an outer end 25*b* of the segment 25, which is to say one facing away from the connecting region 23, and through this segment 25 itself. In this way, the U-shaped segments 26, 27 of the same antenna branch are each connected to the outer end 25*b* of the serpentine segment 25 of the same antenna branch at the other inner ("second") end (26*a*, 27*b*) in an electrically conductive manner.

The yoke-shaped trace segment 24 connects the serpentine segments 25 of the two antenna branches 21, 22 together, and forms a parallel inductor connected between the antenna branches 21, 22. The yoke-shaped trace segment 24 preferably has two first subsections 24*a* parallel to one another, and a second subsection 24*b* that is arranged perpendicular to the first subsections and connects them to one another. Proceeding from the connecting region 23, the yoke-shaped trace segment 24 preferably extends into an unoccupied region between the outer ends 26*b*, 27*a* of the upper antenna branch 21 and the outer ends 26*b*, 27*a* of the lower antenna branch 22.

Each serpentine segment 25 forms a series inductor inserted in its antenna branch.

In addition to the segments 24-27, the antenna 20 preferably has an additional trace segment 28 that connects the two U-shaped segments 27 of the two antenna branches 21, 22 to one another. In this regard, the segment 28 connects, in an electrically conductive manner, the two inner ends 27*b* of the segments 27 of the two antenna branches 21, 22, and thus also connects the two inner ends 26*a* of the segments 26 of the two antenna branches, as well as the two outer ends 25*b* of the serpentine segments 25 of the two antenna branches.

The trace segments 24 and 26-28 are preferably designed to be piecewise linear or polygonal, as can be seen in FIG. 2. The angles between the straight subsections here are each preferably 90 degrees. In other embodiments, "corners" of the traces are rounded or beveled, e.g., with 45-degree or 135-degree angles.

The two antenna branches 21, 22 are preferably designed to be symmetrical to one another in shape. The antenna branch 22 shown at the bottom in FIG. 2 represents a mirror image of the antenna branch 21, shown at the top, reflected at a horizontal axis or plane S passing through the connecting region 23—and vice versa.

In addition, the antenna branches 21, 22 are preferably planar in design and lie in a common plane (drawing plane in FIG. 2).

The two antenna branches 21, 22 preferably each include a thin conductive layer, e.g. of copper, silver, etc., formed on a common substrate, for example of polyimide, or on a printed circuit board. The integrated receive circuit 17 (FIG. 1) of the transponder is also preferably formed on this substrate. Alternatively, the thin conductive layer can be applied to a film on which the integrated receive circuit is arranged using flip-chip technology. The transponder, having at least the antenna and integrated receive circuit, is ultimately applied to the object to be identified.

The antenna branches 21, 22 make contact with the integrated receive circuit 17 of the transponder 15 (FIG. 1) in the connecting region 23. The receive circuit 17 is preferably arranged directly in the connecting region 23. This advantageously simplifies the implementation of the transponder.

As is evident from FIG. 2, the trace segments 24-28 have a trace width that is piecewise constant along the subsections. The trace width preferably remains constant in each straight subsection, but changes "abruptly" from subsection to subsection. Starting from the connecting region 23, the first subsection can have a first width, the next straight subsection can have a second, larger width, and the third subsection can have a third, larger width (in comparison, in turn, to the second width), etc.

The trace width of the U-shaped segments 26 preferably matches the trace width of the U-shaped segments 27 and, if applicable, the trace width of the segment 28. This trace width, which is labeled Wb2 in FIG. 2, takes on a value of 2.0 mm, for example. In contrast thereto, the trace widths in the yoke-shaped segment 24 and the serpentine segments 25 are preferably smaller than in the segments 26, 27. In FIG. 2 the segments 24 and 25 have the same trace width Wb1 by way of example. It takes on a value of 0.5 mm, for example.

The antenna 20 shown in FIG. 2 occupies an area with an overall length L of approximately 87 mm and an overall width W of approximately 23 mm, so that this antenna is especially suitable for production on a strip (W<approximately 35 mm) and/or for applications in which an elongated area is available for the antenna. The largest geometric dimension (L) of this antenna for all wavelengths $\lambda=c/f$ of the operating frequency range fB (with f=840 . . . 960 MHz) is below the value $\lambda/\pi=99$ mm, so that the antenna 20 is an "electrically small" antenna as defined by Wheeler (1975). The antenna 20 is thus especially space-saving, permitting especially simple and economical transponder implementation.

The complex-valued input impedance of the antenna 20 is designated below as Z2=R2+j*X2, where R2 is the effective resistance and X2 is the reactance of the antenna.

Preferably the U-shaped trace segments 26, 27 are designed such that the antenna 20 has an input impedance Z2 with an inductive reactance X2>0 in the operating frequency range fB, whose frequency response X2(*f*) has an inflection point in the mathematical sense in the operating frequency range fB.

Moreover, the yoke-shaped trace segment 24 is preferably designed such that the antenna 20 has values of an inductive input impedance Z2 in the operating frequency range fB that is matched to the complex conjugate value Z1' of the capacitive input impedance Z1 of the integrated receive circuit 17 such that no circuit arrangement for impedance matching is needed between the antenna and the integrated receive circuit (see FIG. 1).

This state of affairs is described below in detail with reference to FIG. 3.

Figure 3:
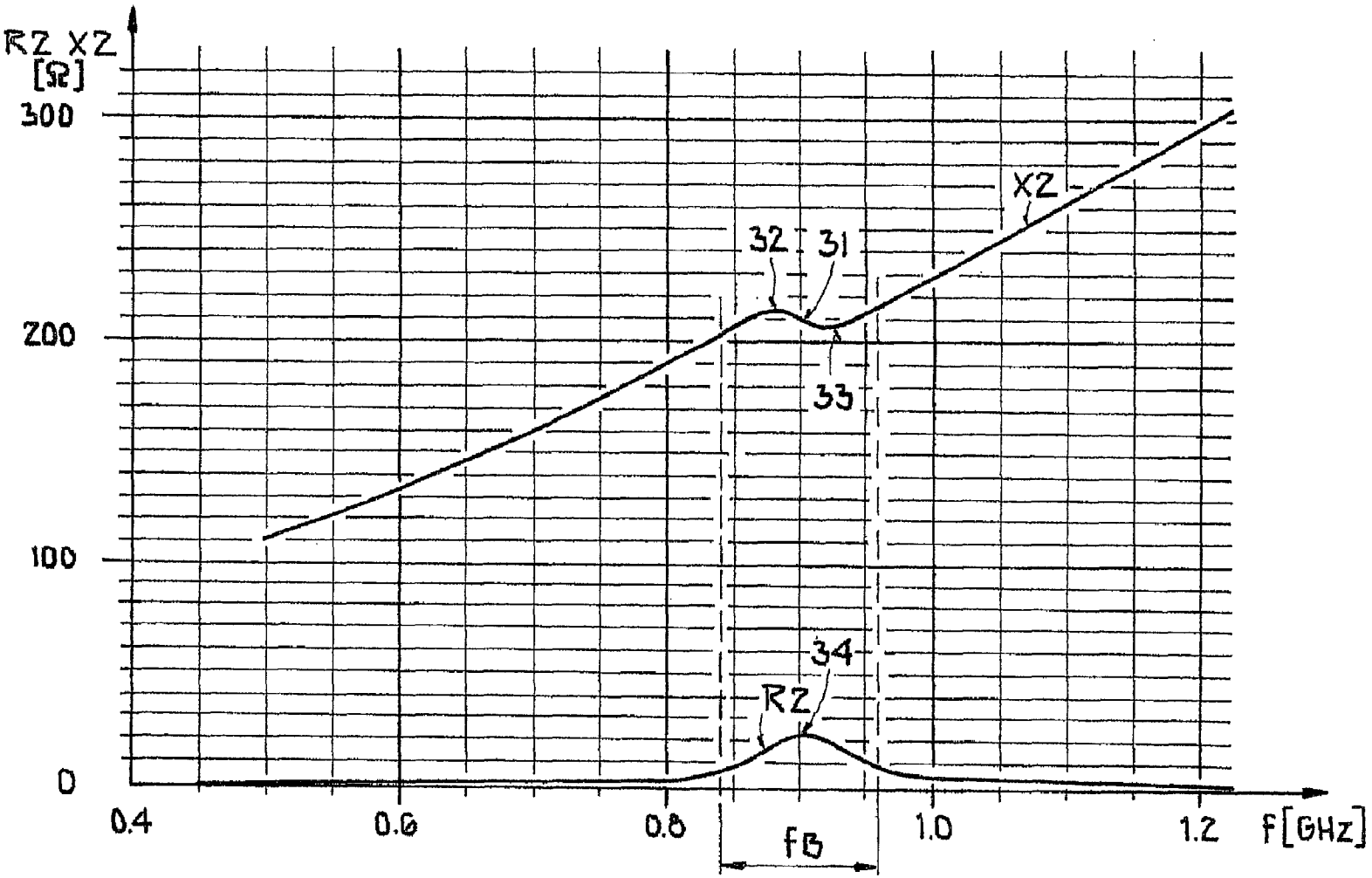
FIG. 3 illustrates a frequency response of the input impedance of an antenna as shown in FIG. 2.

FIG. 3 schematically shows the frequency response of the input impedance Z2 of an inventive antenna as in the exemplary embodiment described above. In the top part of the figure, the reactance X2, which is to say the imaginary component of Z2, is plotted over the frequency f, while the effective resistance R2, which is to say the real component of Z2, is shown in the bottom part. The above-mentioned operating frequency range fB between approximately 840 MHz and approximately 960 MHz is emphasized in FIG. 3.

It is evident from the frequency response X2(*f*) of the reactance that the reactance X2 reaches a high inductive value of over 200 ohms already at the lower limit of the operating frequency range fB, which is to say at approximately 840 MHz. With increasing frequency values, the reactance X2 rises to a local maximum value 32 of approximately 214 ohms, then declines slightly to a local minimum value 33 of approximately 208 ohms, and finally rises again until a value of approximately 215 ohms is reached at the upper limit of the operating frequency range fB, which is to say at approximately 960 MHz. An inflection point 31 of the frequency response X2(*f*) is located at approximately the center of the operating frequency range fB, i.e. at approximately 900 MHz.

The U-shaped trace segments 26, 27 of the above-described antenna 20 are designed such that the reactance X2 of the antenna is inductive (X2>0) in the entire operating frequency range fB and has a frequency response X2(*f*) that has an inflection point 31 as well as a local maximum value 32 and a local minimum value 33 in the operating frequency range fB, each of which is not located at an edge of the operating frequency range fB. To this end, in FIG. 2 the trace length Lu, in particular, along the trace segments 26, 27, i.e. the sum of the path lengths of the U-shaped segments 26, 27 is chosen such that the inflection point 31 and the local maximum and minimum values 32, 33 lie within the operating frequency range fB.

In other embodiments of the antenna, the U-shaped segments are designed such that the frequency response X2(*f*) in the operating frequency range fB has only an inflection point, but no local extreme values, or else has an inflection point and either a local maximum value or a local minimum value.

The values of the inductive reactance X2 of the antenna 20 shown in FIG. 3, in the operating frequency range fB, correspond to a good approximation to the absolute values |X1| of the capacitive reactance X1 of the integrated receive circuit 17 specified above with reference to FIG. 1.

It is evident from the frequency response R2(*f*) of the effective resistance that the effective resistance R2 takes on a small value of approximately 5 ohms at the lower limit of the operating frequency range fB. With increasing frequency values, the value of the effective resistance R2 also increases, until a maximum value 34 of approximately 22 ohms is reached approximately in the center of the operating frequency range fB at approximately 900 MHz. As frequency values continue to rise, the effective resistance R2 then falls again, reaching a value of approximately 8 ohms at the upper limit of the operating frequency range fB. Thus, a local maximum value 34 of R2(*f*) is located within the operating frequency range fB.

Because of the shallow slopes of the frequency responses R2(*f*), X2(*f*) in the operating frequency range fB, the antenna 20 has a wide bandwidth. The bandwidth of the overall system (transponder) depends strongly on the impedance of the integrated receive circuit, the antenna substrate carrier, and the support surface to which the transponder is applied. Investigations carried out by the applicant have yielded bandwidths for the overall system of approximately 80 MHz.

The values shown in FIG. 3 of the effective resistance R2 of the antenna 20, in the operating frequency range fB, correspond to a good approximation to the values R1 of the effective resistance R1 of the integrated receive circuit 17 specified above with reference to FIG. 1.

Under the boundary conditions explained above with reference to FIG. 1, the input impedance Z2=R2+j*X2 of the antenna 20 in the operating frequency range fB thus approximates the complex conjugate values Z1'=R1−j*X1 of the input impedance Z1=R1+j*X1 of the integrated receive circuit 17 sufficiently closely. Advantageously, no separate circuit arrangement for impedance matching is required. The yoke-shaped trace segment 24 of the antenna 20 is designed appropriately for this purpose.

Especially the trace length along the subsections 24*a*, 24*b*, but also the trace width Wb1 is chosen for this purpose such that the ideal case Z2=Z1' is approximated as closely as possible in the operating frequency range fB. Thus, for example, a lengthening of the subsections 24*a* by 1 mm results in an increase of |X2| by approximately 5 ohms, and a lengthening by 2 mm results in an increase of approximately 10 ohms, so that fine adjustment of the impedance matching can be accomplished by such modification.

In this way, power losses in the transponder are reduced so that large ranges result, and wide-band and omnidirectional reception is possible in the entire operating frequency range fB. Investigations carried out by the applicant produced ranges in read operation of approximately 10 m for the USA (4 W EIRP) and approximately 5 m for the European market (500 mW ERP). Moreover, as a result the integrated receive circuit 17 can advantageously be placed directly in a connecting region of the antenna 16 without limitations by separate components for impedance matching, thus permitting especially simple and economical, but nonetheless powerful, transponder implementations.

How closely the inductive input impedance Z2 of the antenna can be made to approach the likewise inductive impedance Z1' in general depends on many boundary conditions, but especially the following: a) the frequency location and width of the desired operating frequency range fB, b) the value of the capacitive input impedance Z1 of the receive circuit 17 and its curve in the operating frequency range, and c) the precise design of the inventive antenna.

As is evident from FIG. 2, the U-shaped trace segments 26, 27 and the yoke-shaped trace segment 24 are advantageously designed such that optimum use is made of the area W×L occupied by the antenna. Thus, in FIG. 2 the horizontal extent of the outer U-shaped trace segments 27 corresponds essentially to the horizontal extent of the antenna in the region of the yoke-shaped trace segment 24, which segment in turn corresponds essentially to the overall width W of the antenna. Moreover, the sum of the lengths of the two right vertical subsections of the U-shaped segments 27 and the subsection 24*b* corresponds to the overall length L of the antenna, with the exception of vertical minimum distances that must be observed between the outer ends 26*b*, 27*a* of the U-shaped segments and the subsections 24*a*. In the U-shaped segments 26, 27, and also in the yoke-shaped trace segment 24 as well, the total trace length required in each case is thus advantageously divided up among the individual horizontal and vertical subsections such that the antenna makes the fullest possible use of the smallest possible area.

In other example embodiments, the inventive antenna has no serpentine segments. Instead, for example, the U-shaped trace segments are designed such that the antenna occupies a more elongated area. This is advantageous in applications in which the overall width W of the antenna is strictly delimited in the upward direction by a small maximum value, while the value of the overall length is of secondary importance.

Even though the present invention has been described above on the basis of example embodiments, it is not restricted thereto, but can instead be modified in multiple ways. Thus, for example, the invention is neither restricted to passive or semi-passive transponders, nor to the specified frequency bands or the specified impedance values of the integrated receive circuit, etc. Rather, the invention can be used to advantage in an extremely wide variety of contactless communications systems.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An antenna comprising:

two branches that each extend outward from a connecting region where the branches are connected to an integrated receive circuit of a backscatter-based radio frequency identification (RFID) transponder, each of the branches comprising a first trace segment connected to the connecting region and a second trace segment connected to the first trace segment, each of the second trace segments extending substantially parallel to its first trace segment, each of the first and second trace segments being substantially U shaped, each of the first and second trace segments being formed from three legs, each of the legs of each the first trace segments being spaced apart from an adjacent one of the legs of its second trace segment; and a third trace segment that connects the two branches to each other, the third trace segment being substantially yoke shaped;

wherein, in each of the branches:

each of the first and second trace segments has a first end and a second end;

the first end of the first trace segment is connected to the first end of the second trace segment;

the second end of the first trace segment is connected to the second end of the second trace segment; and the second end of the first trace segment or the second trace segment is connected to the connecting region.

2. The antenna of claim 1, wherein the first and second trace segments of the same antenna branch extend at a substantially constant spacing from one another.

3. The antenna of claim 1, wherein, in each of the branches:

the first trace segment forms an inner area and the second trace segment is located in the inner area; or the second trace segment forms the inner area and the first trace segment is located in the inner area.

4. The antenna of claim 1, wherein the first and second trace segments are each piecewise linear.

5. The antenna of claim 1, wherein each of the first and second trace segments has a first trace width.

6. The antenna of claim 5, wherein the third trace segment has a second trace width that is smaller than the first trace width.

7. The antenna of claim 1, wherein, at least in part because of one or more design aspects of the third trace segment, the antenna has an inductive input impedance in an operating frequency range that approximates complex conjugate values of a capacitive input impedance of the integrated receive circuit, substantially obviating a circuit arrangement for impedance matching between the antenna and the integrated receive circuit.

8. The antenna of claim 1, wherein, at least in part because of one or more design aspects of the third trace segment, the antenna has values of an inductive input impedance in an operating frequency range with its real component below 35 ohms and its imaginary component having a magnitude above 170 ohms.

9. The antenna of claim 1, wherein each of the branches comprises a fourth trace segment that connects the connecting region to the first trace segment of the branch, the fourth trace segment being substantially serpentine in shape.

10. The antenna of claim 9, wherein the third trace segment connects the fourth trace segments of the two branches to one another.

11. The antenna of claim 9, wherein, in each of the branches, the second end of the first trace segment or the second end of the second trace segment is connected to an end of the fourth trace segment that faces away from the connecting region.

12. The antenna of claim 9, wherein:

the fourth trace segment has a first trace width;

each of the first trace segments has a second trace width; and each of the second trace segments has a third trace width;

the first trace width being smaller than the second or third trace width.

13. The antenna of claim 12, wherein the first trace width is substantially equal to a fourth trace width of the third trace segment.

14. The antenna of claim 1, wherein the antenna further comprises a fourth trace segment that connects the second ends of the second trace segments to one another.

15. The antenna of claim 1, wherein the branches are substantially symmetrical to one another in shape.

16. The antenna of claim 1, wherein the branches are substantially planar in design and substantially lie in a common plane.

17. The antenna of claim 1, wherein the antenna is an electrically small antenna.

18. The antenna of claim 1, wherein an operating-frequency range of the antenna lies in the UHF or microwave frequency range.

19. The antenna of claim 1, wherein, at least in part because of one or more first design aspects of the first and second trace segments, the antenna has an input impedance in an operating-frequency range with an inductive reactance that has a frequency response with an inflection point in the operating-frequency range.

20. The antenna of claim 19, wherein, at least in part because of one or more second design aspects of the first and second trace segments, the frequency response of the reactance has a local maximum value or a local minimum value within the operating-frequency range.

21. The antenna of claim 20, wherein the one or more first design aspects and the one or more second design aspects comprise the same one or more design aspects.

22. The antenna of claim 19, wherein, at least in part because of trace lengths along the first and second trace segments, the frequency response of the reactance has an inflection point, a local maximum value, or a local minimum value in the operating frequency range.

23. A transponder comprising:

an integrated receive circuit with a capacitive input impedance; and an antenna connected to the integrated receive circuit, the antenna comprising:

two branches that extend outward from a connecting region where the branches are connected to the integrated receive circuit, each of the branches comprising a first trace segment connected to the connecting region and a second trace segment connected to the first trace segment, each of the second trace segments extending substantially parallel to its first trace segment, each of the first and second trace segments being substantially U shaped, each of the first and second trace segments being formed from three legs, each of the legs of each the first trace segments being spaced apart from an adjacent one of the legs of its second trace segment; and a third trace segment that connects the two branches to each other, the third trace segment being substantially yoke shaped;

wherein, in each of the branches:

each of the first and second trace segments has a first end and a second end;

the first end of the first trace segment is connected to the first end of the second trace segment;

the second end of the first trace segment is connected to the second end of the second trace segment; and the second end of the first trace segment or the second trace segment is connected to the connecting region.

24. The transponder of claim 23, wherein the integrated receive circuit is located in the connecting region of the antenna.

25. The transponder of claim 23, wherein each of the branches comprises a thin conductive layer that is formed on a substrate and the integrated receive circuit is formed on the substrate.

* * * * *